US005513998A

United States Patent [19]

Kim

[11] Patent Number: 5,513,998

[45] Date of Patent: May 7, 1996

[54] ELECTRICAL PLUG ASSEMBLY WHICH ACCOMMODATES MULTIPLE VOLTAGE

[76] Inventor: Jungshin Kim, #491-9, Pyungchang-Dong, Chongno-Ku, Seoul 110-012, Rep. of Korea

[21] Appl. No.: 271,749

[22] Filed: Jul. 7, 1994

[30] Foreign Application Priority Data

Jan. 14, 1994 [KR] Rep. of Korea ..... 94-637

[51] Int. Cl.[6] ..... H01R 29/00

[52] U.S. Cl. ..... 439/170

[58] Field of Search ..... 439/170–175, 439/218, 221–223, 189

[56] References Cited

U.S. PATENT DOCUMENTS 4,997,381 3/1991 Oh ..... 439/172

FOREIGN PATENT DOCUMENTS 87-1384 4/1987 Rep. of Korea .
92-4314 6/1992 Rep. of Korea .

*Primary Examiner*—Gary F. Paumen
*Attorney, Agent, or Firm*—Birch, Stewart, Kolasch & Birch

[57] ABSTRACT

A plug assembly includes a main plug member having a pair of main plugs, a pair of elongated cylindrical apertures and a pair of elongated rectangular apertures, and a plug adapter member having a pair of cylindrically shaped terminals and a pair of elongated cylindrical first apertures disposed on one side wall and a pair of rectangular shaped terminals and a pair of elongated cylindrical second apertures disposed on other side wall thereof, the cylindrical shaped terminals and rectangular shaped terminals connecting to the first and second apertures, respectively, whereby the plug assembly enables the selective use of either one terminals or other terminals depending upon high voltage or low voltage usage.

8 Claims, 2 Drawing Sheets

ELECTRICAL PLUG ASSEMBLY WHICH ACCOMMODATES MULTIPLE VOLTAGE

BACKGROUND OF THE INVENTION

1. Field of the Invention

The present invention relates to an electrical plug assembly which accommodates a multiple voltage and more particularly, to an improved plug assembly including a main plug member with a pair of main plugs, a pair of elongated cylindrical apertures and a pair of elongated rectangular apertures, and a plug adapter member with a pair of cylindrically shaped terminals and a pair of elongated cylindrical first apertures disposed on one side wall and a pair of rectangular shaped terminals and a pair of elongated cylindrical second apertures disposed on the other side wall thereof, the cylindrical shaped terminals and rectangular shaped terminals connecting to the first and second apertures, respectively, whereby the plug assembly enables the selective use of either one terminal or other terminals depending upon high voltage or low voltage usage.

2. Description of Related Art

Various types of electric plugs for use in dual voltages are well known in the art. Such electric plugs include a voltage converting device or a pair of plugs disposed therein. However, such electric plugs suffer from a number of problems such as, for example, the voltage converting device is frequently out of order; when one of pair of plugs is in an inoperative position, the other of them has to be masked so that it is inconvenient for operation thereof; and it is dangerous since it often occurs the accidental interference between the plugs.

For example, as shown in FIG. 8, there is an electrical plug assembled with at least one high voltage or one low voltage plug adapter 30. However, since these plug adapters are of various types, it is difficult to find a proper plug adapter and to safe-keep them.

In order to solve the above problems, as shown in FIG. 9, Korean Utility Model Publication No. 87-1384 discloses a dual function, electrical plug including a plug adapter 40 with a pair of 110 voltage terminals 50 and a pair of 220 voltage terminals 60 disposed on opposing sides thereof, respectively, and an electrical plug 70 with a pair of elongated apertures 80 and 90 for slidably receiving the pair of elongated terminals 50 and 60, respectively. However, when the dual function, electrical plug is separated from a plug receptacle, the plug adapter 40 always remains on the plug receptacle and it is dangerous to pull out the plug adapter 40 from the plug receptacle. In order to solve the above problem, the dual function, electrical plug is provided with a latch 100. However, such dual function, electrical plug is complicated in structure and is not economical in use.

Another Korean Utility Model Publication No. 92-4314 discloses a dual function, electrical plug including a pair of electrical wires for use in a 110 voltage and a 220 voltage. However, since the 110 and 220 voltage wires are positioned adjacent to each other, use thereof can be dangerous.

Furthermore, these dual function, electrical plugs of Korean Utility Model Publication Nos. 87-1384 and 92-4314 do not disclose the use of a pair of projecting engagement members extending from the electrical plug so that they are difficult to use without the plug adapter.

SUMMARY OF THE INVENTION

Accordingly, it is an object of the present invention to provide an improved electrical plug assembly for use in conjunction with electrical appliances, which eliminates the above problems encountered with conventional electrical plug assemblies.

Another object of the present invention is to provide a dual function, electrical plug assembly including an electrical plug with apertures and a pair of elongated projecting engagement members, a pair of elongated circular apertures, and a pair of elongated rectangular apertures disposed thereon and an electric plug adapter with a pair of elongated apertures and a pair of elongated circular terminals, a pair of elongated apertures and a pair of elongated rectangular terminals disposed on both sides thereof for slidably inserting into the pair of elongated circular and rectangular apertures and receiving the projecting engagement, respectively, whereby the electric plug assembly can accommodate multiple voltages, for example, such as 110 voltage and 220 voltage.

A further object of the present invention is to provide a dual function, electrical plug for use in an electric appliance which is simple in construction, compact for portability, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a dual function, electrical plug assembly which comprises an electrical plug including a pair of cylindrically shaped pin members, a pair of cylindrically shaped apertures and a pair of elongated rectangular shaped apertures, and a plug adapter including a pair of cylindrically shaped apertures, a pair of cylindrically shaped pin members and a pair of elongated rectangular shaped pin members for correspondingly mating with each other, whereby the dual function, electric plug assembly can effectively accommodate a multiple voltage.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
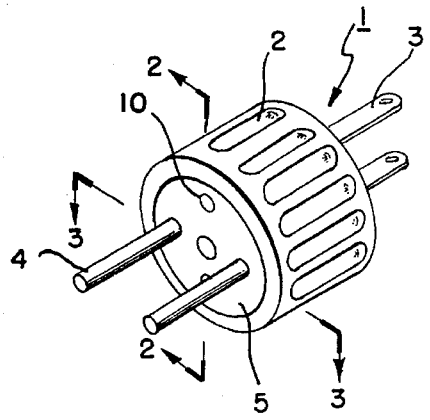
FIG. 1 is a perspective view of a plug adapter of the electrical plug assembly which accommodates a multiple voltage according to the present invention.
Figure 6:
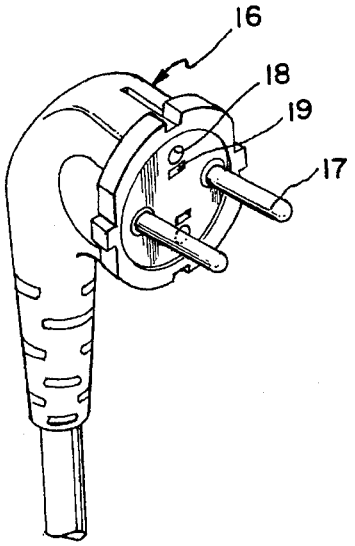
FIG. 6 is a perspective view of an electrical plug of the electrical plug assembly according to the present invention.

Referring now in detail to the drawings for the purpose of illustrating preferred embodiments of the present invention, the electrical plug assembly which accommodates multiple voltages as shown in FIGS. 1 and 6, comprises an electrical plug member 16 and a plug adapter member 1 for alternatingly assembling with and disassembling from the electrical plug member 16 so as to accommodate a multiple voltage, for example, such as 110 voltage and 220 voltage.

As shown in FIGS. 1, 2, 3, 4, and 5, the plug adapter member 1 having a cylindrical configuration includes a round body member 2, and a first cover 5 for high voltage, 220 V and a second cover 6 for low voltage, 110 V, attached to both side walls of the body member 2 by bolts 7 and 8 through apertures 14 of both covers 5 and 6.

The plug adapter member further includes a pair of cylindrically shaped terminals 4 for high voltage, 220 V, usage outwardly disposed on the first cover side wall and a pair of cylindrically shaped apertures 10 interiorly disposed in the first cover side wall of the round body member 2, and a pair of elongated rectangular shaped terminal 3 for low voltage, 110 V, usage outwardly disposed on the second cover side wall and a pair of cylindrically shaped apertures 12 interiorly disposed in the second cover side wall of the round body member 2.

Figure 2:
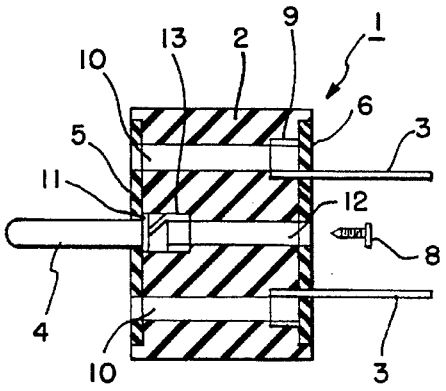
FIG. 2 is a cross-sectional view of FIG. 1, taken along line A—A.
Figure 3:
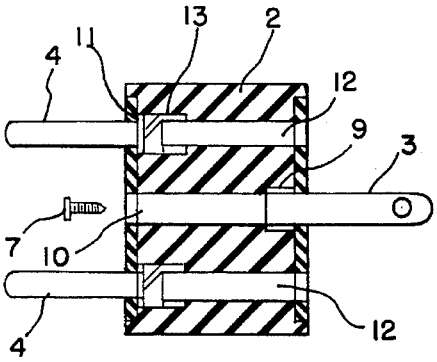
FIG. 3 is a cross-sectional view of FIG. 1, taken along line B—B.

As shown in FIGS. 2 and 3, the pair of terminals 4 are connected to the pair of cylindrically shaped apertures 12 through a pair of second connecting members 13 for low voltage, 110 V, usage and a pair of annular ports 11, respectively, and the pair of terminals 3 are connected to the pair of cylindrically shaped apertures 10 through a pair of first connecting members 9 for high voltage, 220 V, usage, respectively.

Figure 4:
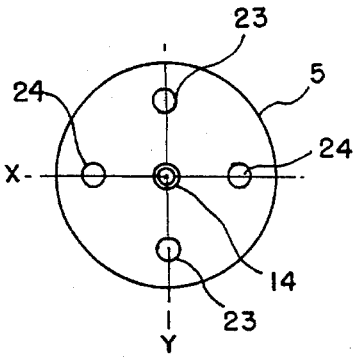
FIG. 4 is a top plan view of a first cover of the plug adapter of the electrical plug assembly according to the present invention.
Figure 5:
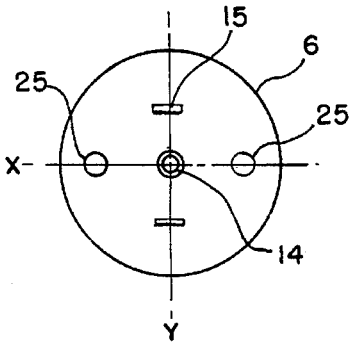
FIG. 5 is a top plan view of a second cover of the plug adapter of the electrical plug assembly according to the present invention.

As shown in FIG. 4, the first cover 5 is provided with a pair of circular apertures 23 which communicate with the pair of apertures 10, and a pair of circular apertures 24 for passing through the pair of terminals 4. As shown in FIG. 5, the second cover 6 is provided with a pair of rectangular apertures 15 for passing through the pair of terminals 3 and a pair of circular apertures 25 which communicate with the pair of apertures 12.

As shown in FIGS. 4 and 5, the pair of circular apertures 23 disposed on a Y axis and the pair of circular apertures 24 disposed on an X axis are disposed crosswise from each other, and the pair of rectangular apertures 15 disposed on a Y axis and the pair of circular apertures 25 disposed on an X axis are disposed crosswise from each other so as to block the flow of electricity to each other, respectively. That is, the low voltage and high voltage. Accordingly, the apertures 23 and 24 of the first cover 5, and the aperture 25 of the second cover 6 are for use with the high voltage and the apertures 15 of the second cover 6 are for use with the low voltage. Finally, these arrangements can prevent the accidental interference between plugs.

Figure 7:
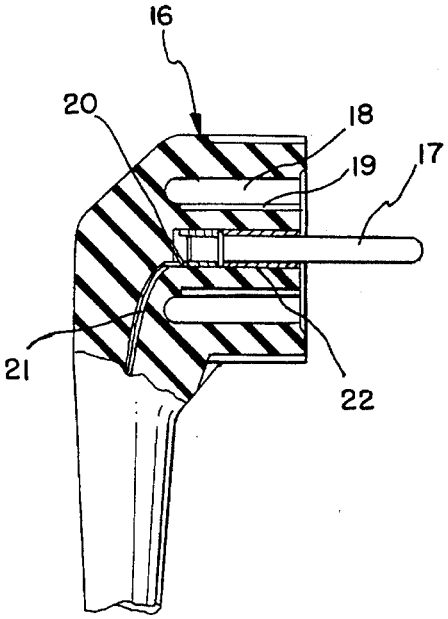
FIG. 7 is a sectional view of FIG. 6.
Figure 8:
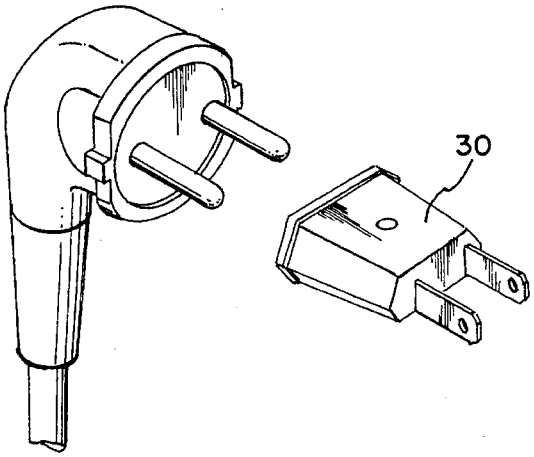
FIG. 8 CONVENTIONAL ART
FIG. 8 is an exploded perspective view of a conventional, electrical plug assembly.
Figure 9:
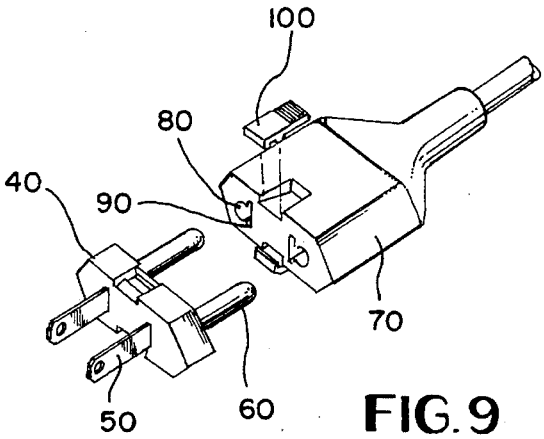
FIG. 9 CONVENTIONAL ART
FIG. 9 is an exploded perspective view of another conventional, electrical plug assembly.

As shown in FIGS. 6 and 7, the electrical plug member 16 used in conjunction with an electric appliance includes a pair of cylindrically shaped main plugs 17 attached to a wall thereof, and a pair of cylindrically shaped apertures 18 for slidably receiving the pair of terminals 4 and a pair of elongated rectangular shaped terminals 3, respectively. These pair of apertures 18 and 19 and main plug 17 are located crosswise from each other so as to shut off electricity. At this time, the distance between both apertures 19 is shorter than that between both apertures 18 for mating with the pair of terminals 3 and the pair of terminals 4 so as to eliminate the mistake of putting the terminals 3 and 4 into the wrong portion of the plug adapter member 1.

The pair of main plugs 17 for use in high voltage, 220 V, usage are connected to electric wires 21 of the electric appliance through a pair of connecting parts 20, respectively, and the pair of main plugs 17 are surrounded with a pair of bushings 22, respectively.

The electrical plug assembly according to the present invention operates as follows. When the user is going to use low voltage, 110 V and the pair of terminals 4 of the plug adapter member 1 are inserted into the pair of apertures 18 of the plug member 16, the pair of main plugs 17 of the plug member 16 are simultaneously inserted into the pair of apertures 10 of the plug adapter member 1 and are connected to the pair of terminals 3 for use in low voltage, 110 V, usage through the connecting members 9. Therefore, the electric appliance is converted to low voltage, 110 V, usage.

Thereafter, when the user is going to use high voltage, 220 V, again, after the plug adapter member 1 is separated from the electric plug member 16, the pair of terminals 3 of the plug adapter member 1 are inserted into the pair of apertures 19 of the plug member 16. At this time, the pair of main plugs 17 of the plug member 16 simultaneously are inserted into the pair of apertures 12 of the plug adapter member 1 and are connected to the pair of terminals 4 for use in high voltage, 220 V, usage through the connecting members 13 and the annular ports 11. Therefore, the electric appliance is converted to the high voltage, 220 V, usage again.

If the pair of main plugs 17 of the plug member 16 connected to the electric appliance are an elongated rectangular shaped terminal for use in low voltage, 110 V, usage, respectively, the apertures 10 and 12 of the plug adapter member 1 should be an elongated rectangular shaped groove, respectively for mating with the main plugs 17.

Accordingly, the electrical plug assembly which accommodates multiple voltages according to the present invention has a number of advantages as follows. It is convenient to enable the selective use of either the pair of elongated rectangular terminals 3 or the pair of cylindrically shaped terminals 4 depending upon low voltage usage or high voltage usage in the composite structure state. It is not dangerous since the low voltage terminals 3 and high voltage terminals 4 are insulated from each other. It is durable in use since the electrical plug assembly forms a composite structure and do not easily separate from each other.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical plug assembly which accommodates multi-voltages for use in conjunction with an electric appliance, which comprises:

an electrical plug member attached to said electric appliance, said electrical plug member including, a pair of cylindrically shaped main plugs mounted to a side wall thereof, a pair of cylindrically shaped main apertures disposed on said side wall, and a pair of elongated rectangular shaped apertures disposed on said side wall and inside of said pair of cylindrically shaped main apertures, said main plugs being located normal to said main apertures and said elongated rectangular apertures for preventing an electrical connection therebetween;

a plug adapter member assemblable with and disassemblable from said electrical plug member, said plug adapter member including, a round body member having a cylindrical configuration and first and second side walls disposed on opposing sides thereof respectively a first cover and a second cover attached to said first and second side walls, respectively a pair of cylindrically shaped terminals mounted to said first cover, a pair of cylindrically shaped first apertures disposed on said first cover, said pair of cylindrically shaped terminals and said pair of first apertures being located normal to each other for preventing an electrical connection therebetween, a pair of elongated rectangular shaped terminals mounted to said second cover, a pair of cylindrically shaped second apertures disposed on said second cover, said pair of elongated rectangular shaped terminals being located normal to said pair of cylindrically shaped second apertures for preventing an electrical connection between said pair of rectangular-shaped terminals and said pair of cylindrically-shaped second apertures, wherein assembly of the plug adapter member with the electric plug member forms a composite structure enabling the selective use of either the cylindrically shaped terminals or the elongated rectangular shaped terminals depending upon high voltage or low voltage usage.

2. The electrical plug assembly of claim 1, wherein said pair of cylindrical main plugs are connected to electric wires of the electric appliance through connecting parts and are surrounded with bushings.

3. The electrical plug assembly of claim 1, wherein a distance between said pair of elongated rectangular apertures is shorter than a distance between said pair of cylindrically shaped main apertures.

4. The electrical plug assembly of claim 1, wherein said pair of elongated rectangular shaped terminals are connected to said pair of first apertures through first connecting members.

5. The electrical plug assembly of claim 1, wherein said pair of cylindrically shaped terminals are connected to said pair of second apertures through second connecting members and annular ports.

6. The electrical plug assembly of claim 1, wherein said first and second covers are attached to both walls of said plug adapter member by bolts.

7. The electrical plug assembly of claim 6, wherein said first cover include two pairs of circular apertures, said pairs of apertures being positioned normal to each other for slidably receiving the pair of cylindrically shaped terminals and the pair of cylindrically shaped main plugs so as to prevent current flow.

8. The electrical plug assembly of claim 6, wherein said second cover include a pair of circular apertures and a pair of rectangular apertures, said apertures being positioned normal to each other for slidably receiving the pair of elongated rectangular shaped terminals and the pair of cylindrically shaped main plugs so as to prevent current flow.

* * * * *